United States Patent [19]

Boodman et al.

[11] 4,436,615

[45] Mar. 13, 1984

[54] PROCESS FOR REMOVING SOLIDS FROM COAL TAR

[75] Inventors: Norman S. Boodman, Penn Hills Township, Allegheny County; Elvin L. Farr, Greensburg; Robert J. Osterholm, Murrysville, all of Pa.; Neulan B. Green, III, Birmingham, Ala.

[73] Assignee: United States Steel Corporation, Pittsburgh, Pa.

[21] Appl. No.: 493,118

[22] Filed: May 9, 1983

[51] Int. Cl.[3] ..... C10C 1/00; C10G 31/00; C10G 31/09; C10G 31/10

[52] U.S. Cl. ..... 208/177; 208/39; 210/781; 210/787

[58] Field of Search ..... 210/781, 787; 208/177, 208/39

[56] References Cited

U.S. PATENT DOCUMENTS

| | | | |
|---|---|---|---|
| Re. 25,467 | 10/1963 | Logan et al. | 208/39 |
| 2,366,900 | 1/1945 | Weir | 208/39 |
| 2,539,915 | 1/1951 | Lindgren | 252/346 |
| 2,683,107 | 7/1954 | Harrisville | 196/14.1 |
| 2,774,716 | 12/1956 | Klulik | 208/45 |
| 2,871,181 | 1/1959 | Kulik | 208/45 |
| 2,956,944 | 10/1960 | Logan et al. | 208/39 |
| 3,010,893 | 11/1961 | Kulik | 208/8 |
| 3,035,308 | 5/1962 | Ragoss et al. | 18/54.7 |
| 3,692,668 | 9/1972 | McCoy et al. | 208/781 |
| 3,799,865 | 3/1974 | Suetsugu et al. | 208/131 |
| 4,036,603 | 7/1977 | Bernet et al. | 208/39 |
| 4,107,382 | 8/1978 | Augustine et al. | 428/368 |
| 4,264,453 | 4/1981 | Mraovich | 210/774 |
| 4,277,324 | 7/1981 | Greenwood | 208/45 |
| 4,316,331 | 2/1982 | Lindstrom et al. | 210/781 |

*Primary Examiner*—Delbert E. Gantz
*Assistant Examiner*—Helane E. Maull
*Attorney, Agent, or Firm*—W. Gary Goodson

[57] ABSTRACT

A process for removing solids from coal tar for the preparation of a coal tar pitch containing liquid comprising (1) centrifuging the coal tar at a suitable viscosity to separate a large particle size solids fraction from a first liquid fraction containing pitch and small particle size solids, and (2) filtering the large particle size fraction while maintaining the solids fraction at a suitable viscosity to thereby produce a second pitch containing liquid fraction which is substantially free of solids, and a densified readily handleable large particle size solid material. The liquid fractions are useful for making electrodes, needle coke or carbon fibers whereas the densified solid material is readily utilized.

28 Claims, 2 Drawing Figures

PROCESS FOR REMOVING SOLIDS FROM COAL TAR

FIELD OF THE INVENTION

This invention relates to a process for removing solids, such as coal and coke fines, from coal tar, and to processes for producing pitch, pitch products, and densified solids therefrom.

BACKGROUND OF THE INVENTION

Coal tar, and especially the high temperature coal tar recovered as a by-product of metallurgical coke manufacture, can be converted by distillation to a pitch that has utility as a binder component in the production of anodes used in aluminum reduction cells and graphite electrodes used in electric-arc furnaces. With controlled quality of the binder pitch, it is possible to achieve advantageous properties in the anodes, such as high mechanical strength, good electrical conductivity, and low carbon consumption rates during the electrolysis process. However, certain impurities in the tars, which are transferred to the product pitch, may exert deleterious effects. These impurities are generally quantified by a solvent extraction technique employing quinoline as the solvent. The quinoline insolubles (QI), which denote the degree of contamination of the tar, consist essentially of coal-derived solids (coal, coke, cenospheres) and by-product-derived solids (carbon blacks, pyrolysis blacks). Coal-derived contaminants, in addition, contain the inherent mineral matter associated with the feed coal to the coke ovens, and various of the elements in the mineral matter (Na, Si, V, P) are in themselves undesirable as components in the aluminum reduction cells. It is, therefore, of critical importance to be able to remove a large proportion of the solid particulates in the coal tar and thus render the tar suitable for production of anode-binder pitch, as well as other related products.

The most common techniques applicable for upgrading tar quality include filtration, gravity settling, and centrifugation. Because of the "sticky" nature of coal tar, filtration is not easily accomplished, as the tar solids readily blind the filter media and produce unacceptably low filtration rates even when large quantities of filter aids are employed. Depending on the viscosity of the tar, simple gravity settling may only be partially effective, and the yield of usable tar may therefore be low.

Depending on the extent of contamination of the tar and the resultant viscosity, centrifugation may effect a moderate-to-high degree of purification. A serious shortcoming of centrifugation, however, lies in the co-production of a thickened bottoms (sludge) fraction that is not amenable to ready disposal. Proper disposal of this sludge often requires transporting the material to expensive landfills. Because of the tarry nature of the material, it presents serious handling problems.

In U.S. Pat. No. 4,036,603, incorporated herein by reference, coal tar is centrifuged to produce a liquid phase consisting of tar substantially free of solids and a solid phase consisting of solid matter wetted with tar. To overcome the disposal problem for the solid phase, this solids phase is combined with solid carbon-containing material, such as coal or coke dust, and mixed in a screw mixer to improve the handling properties. This solid material can then be readily transported for use or disposal. One of the problems with this process is that considerable valuable chemicals in the liquid tar are lost with the solid matter, or at least not readily recovered without complete reprocessing through coke ovens or the like. An additional problem is that the liquid phase often contains such a high solids content that the pitch derived from the process cannot even be utilized for a binder for electrodes. For a useful binder pitch, the QI level should be between about 10 and about 20 weight percent, and ash content should be below about 0.30 weight percent.

Some of the prior art, such as U.S. Pat. No. 4,264,453, incorporated herein by reference, also requires special non-aromatic solvents which results in extremely high costs for the process and results in contamination of the various coal-tar products (pitch and distillates) which must, by specification, be wholly aromatic.

SUMMARY OF THE INVENTION

This invention relates to a process for removing solids from coal tar for the preparation of a coal tar pitch containing liquid comprising (1) centrifuging the coal tar at a suitable viscosity to separate a large particle size solids fraction from a first liquid fraction containing pitch and small particle size solids, and (2) filtering the large particle size fraction while maintaining the fraction at a suitable viscosity to thereby produce a second pitch containing liquid fraction which is substantially free of solids, and a densified readily handleable large particle size solid material.

Not only does this invention recover more of the coal tar chemical value than the prior art process mentioned above, but additionally the second liquid fraction has such a low solids content (less than about 2% by weight QI and generally less than 1% by weight QI) that the pitch derived therefrom makes an excellent impregnating pitch or can be utilized for making high quality needle coke or carbon fibers. Furthermore, the pitch derived from this second liquid fraction, because of its very low solids content, can be combined with pitch derived from the first liquid fraction to produce a pitch binder of further reduced solids content, which may be required for certain applications for which standard binder pitch (i.e., with QI of 10–20%) may be regarded as having too high a solids content. An additional advantage is that the process of this invention can, for viscosity control, utilize heat or liquids produced by the process itself (as diluents) thus eliminating a major drawback of some prior art processes.

A further advantage of this invention is that the centrifuging and filtering steps are accomplished rapidly without risk of hang up in the centrifuge or blinding of the filter media. Additionally, the ratio of first liquid fraction to second liquid fraction can be controlled simply by adjusting the centrifuging operation to increase or decrease the ratio of first liquid fraction to large particle size solids fraction coming from the centrifuge. Furthermore, all types of tarry sludge materials from tar plant operation can be handled effectively through the filter. These include tar-decanter sludge, centrifuge underflow, and tank settlings (bottoms). Thus, the existence of potentially hazardous waste materials is avoided.

BRIEF DESCRIPTION OF THE DRAWINGS

The drawings show preferred embodiments of the invention.

DETAILED DESCRIPTION OF THE INVENTION

Figure 1:
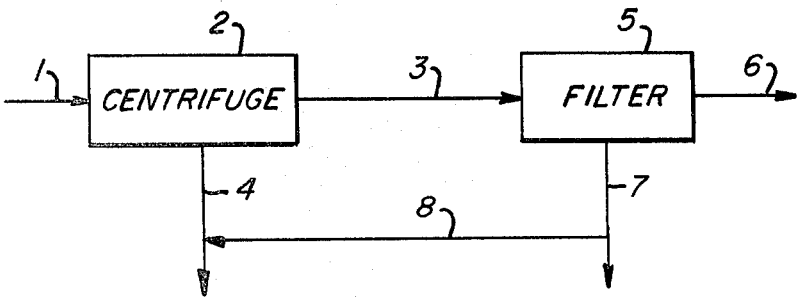
FIG. 1 is a schematic flow diagram showing the basic two-step process of this invention.

The centrifuging can be conducted in any suitable centrifuge of the type which will cause a separation between the large and small particle size solids materials. A solid-bowl type centrifuge is preferred.

The viscosity of the coal tar during centrifuging is maintained by controlling the temperature of said coal tar and/or the amount and type of diluent mixed with said coal tar. The viscosity of the coal tar during centrifugation is preferably maintained below about 400 SUS, and more preferably between about 100 and about 200 SUS. The viscosity of the coal tar during centrifugation may also be controlled by varying temperature. Preferably the coal tar temperature is maintained between about 140° F. and about 325° F., and more preferably between about 200° F. and about 300° F.

The small particle size material generally has an average size of less than about 10 microns, whereas the large particle size solids generally has an average particle size greater than about 10 microns. The speed of the centrifuge, residence time, and other conditions will be varied depending upon the type of coal tar, viscosity of the coal tar, and other characteristics of the coal tar in order to get the desired separation.

Suitable diluents for use in the invention may be any of the well known diluents for coal tar. Especially preferred is a coal tar liquid such as the first or second liquid fractions produced by the process of this invention, coal tar, or coal tar distillates. A full range, or any portion thereof, of coal tar distillates may be used as the coal tar diluent of this invention.

It is essential that in the centrifuging step of this invention sufficient of the small particle size solids are separated from the large particle size solids fraction that this large particle size solids fraction can be successfuly filtered, and preferably without the use of filter aid. Preferably the filtration rate is at least one gallon per hour per square foot of filter surface, and more preferably at least six gallons per hour per square foot. Prior art attempts to filter raw tar which had been mixed with diluent were total failures without the use of filter aid. By using large amounts of filter aid, it was possible to achieve up to about 0.6 gallon per hour per square foot when treating such viscosity adjusted raw tar.

A screen-type filter is especially preferred. It may come in any of the different forms, such as a vertical leaf filter, a cylindrical screen (candle-type), or the like. The screen may be utilized with or without filter aid. One of the advantages of this invention is that generally it has been found possible to eliminate the need for filter aid with its resultant extra costs and contamination of the products, due to separation of sufficient small particle size solids from the tarry, large particle size solids fraction being filtered.

The process of this invention also comprises the additional step of distilling one or more of the liquid fractions separated in the separation steps of this invention to thereby produce a pitch product which is useful (1) as a binder for carbon anodes for aluminum reduction cells, (2) as a binder for graphite electrodes for electric arc steelmaking furnaces, (3) as an impregnating pitch for the manufacture of graphite electrodes, or (4) for the production of needle coke or carbon fibers.

The invention also includes the novel products produced from this invention, such as the pitch product derived from distillation of the second liquid fraction, graphite electrode or carbon anode made from pitch derived from distillation of the second liquid fraction of this invention, and needle coke or carbon fibers made from pitch derived from distillation of the second liquid fraction of this invention.

The process of this invention also includes the additional step wherein the densified solid material is selectively added to the coal of coke ovens, and carbonized to produce a useful coke product for use in blast furnaces, as well as the coke product so produced, as well as the use of this coke product in producing iron.

Generally, the pitch produced from the second liquid fraction, obtained from the filtration step, contains less than about 2% by weight of QI solids, and preferably less than 1% by weight.

A preferred process according to this invention for removing solid contaminants from a coal tar comprising (1) drying the coal tar to produce an essentially dry coal tar, (2) mixing into the coal tar a suitable diluent to adjust the viscosity of the coal tar to a suitable viscosity for carrying out the objects of step (3), (3) centrifuging the coal tar having a suitable viscosity to separate a large particle size solids fraction from a first liquid fraction containing pitch and small particle size QI solids, (4) mixing the large particle size solids fraction with a suitable diluent to thereby maintain a readily filterable viscosity in the separated large particle size solids fraction, and (5) filtering the large particle size fraction while maintaining the fraction at the readily filterable viscosity to thereby produce a second pitch containing liquid fraction which is substantially free of solids, and a densified readily handleable substantially dry filter cake.

In FIG. 1, coal tar contaminated with QI solids which has a suitable viscosity is added through line 1 to operating centrifuge 2 to thereby separate a large particle size solids fraction which passes through line 3 to filter 5. The solids fraction is maintained at a readily filterable viscosity as it passes through the filter 5 to thereby produce a densified large particle size filter cake which leaves the filter through means 6. A first liquid fraction containing pitch and small particle size solids leaves centrifuge 2 through line 4. A second liquid fraction containing pitch and substantially free of solids leaves filter 5, as a filtrate, through line 7. This filtrate may be combined with the first liquid fraction in line 4, if desired by passing the filtrate through line 8.

Figure 2:
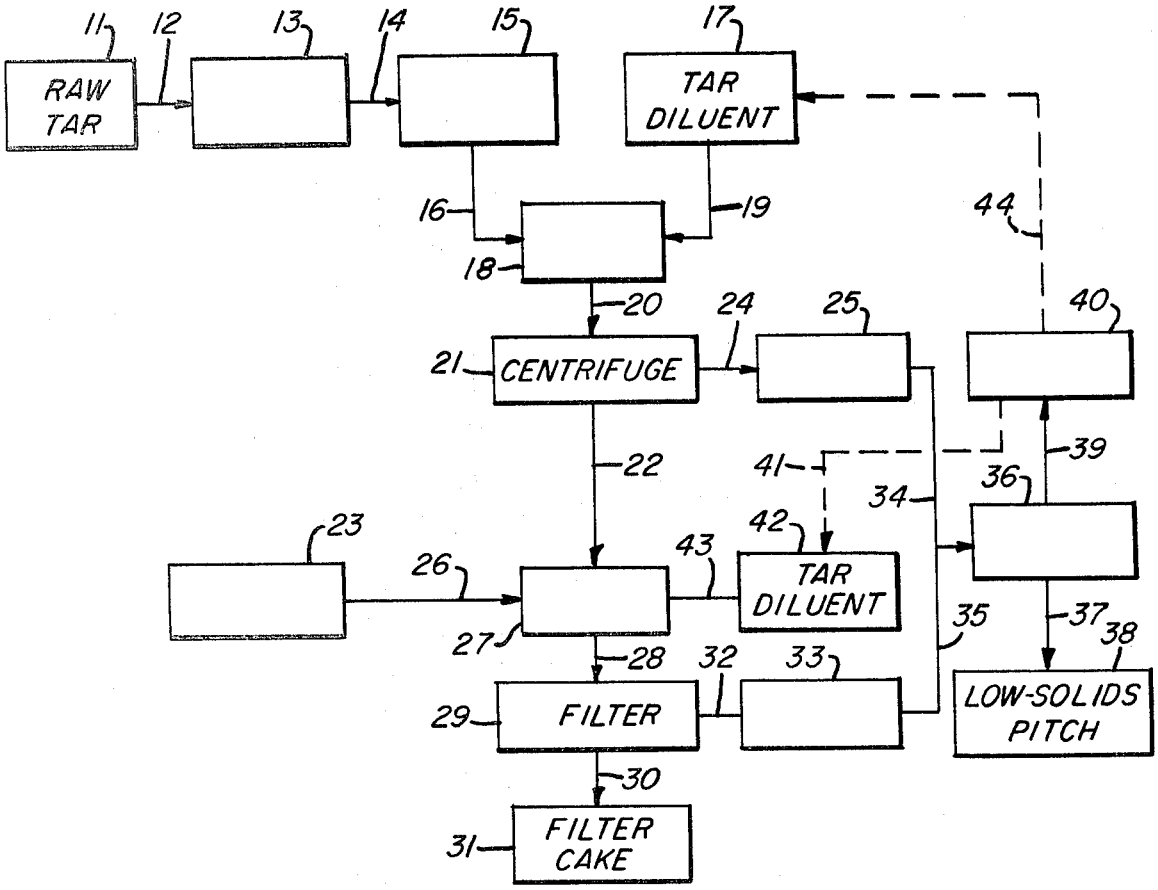
FIG. 2 is a schematic flow diagram showing a preferred process for producing a valuable low solids pitch and a highly usable solid filter cake from raw coal tar, and optionally coal tar decanter sludge.

In FIG. 2, a preferred coal tar upgrading process is described wherein raw coal tar 11 passes through line 12 to dehydrator 13 where it is dried, preferably in a flashing unit, to produce an essentially dry tar 15. This dry tar 15 is passed through line 16 to mix tank 18 where it is mixed with coal tar diluent from tank 17 which passes through line 19 to the mix tank 18. In the mix tank 18 the coal tar viscosity is adjusted to make it readily centrifuged to accomplish the desired separation described above. The viscosity adjusted tar is passed through line 20 to centrifuge 21 to produce a large particle size solids fraction (centrifuge underflow) which passes through line 22 to mix tank 27 where suitable viscosity is achieved for these solids by mixing with tar diluent from tar diluent tank 42 which passes through line 43 to mix tank 27. Optionally, tar decanter sludge from tank 23 may also be added to mix tank 27, through line 26. The large particle size solids having a readily filterable viscosity is then added to filter 29, which may be a pressure filter, candle filter, or other alternate, where a densified large particle size solids material in the form of a filter cake is produced and passed through line 30 to filter cake storage 31. The first liquid fraction containing pitch from centrifuge 21 is passed through line 24 to centrate storage 25. The second liquid fraction, from filter 29, is passed through line 32 to filtrate storage 33. The two liquid fractions may then be distilled, either separately or together, by passing through lines 34 and 35 to distillation means 36. Low-solids pitch passes through line 37 to storage tank 38. Tar diluent passes through line 39 to storage tank 40. The tar diluent may then be recycled through lines 41 or 44 for use in adjusting the viscosity of the material to be centrifuged or filtered.

The following examples are given by way of illustration and are not intended to limit the scope of the invention.

EXAMPLE 1

A crude, heavy, high temperature coal tar obtained as a by-product of a metallurgical coke process is dried, heated to 300° F., and passed through a solid-bowl centrifuge (nominal capacity=25 GPM) at the rate of 15 GPM, with the centrifuge bowl rotating at a speed corresponding to 2800 gravitational forces (G-forces). Total solids (measured as quinoline-insolubles by ASTM procedure D2318) and ash contents (ASTM D2415) are determined for the feed, centrifuged tar (centrate) and centrifuge underflow, and are summarized in weight percent below.

| Fraction | % QI | % Ash |
|---|---|---|
| Centrifuge Feed | 12.1 | 0.20 |
| Centrate | 9.8 | 0.05 |
| Underflow | 43.9 | 3.2 |

Thus, the feed tar is reduced in total solids content by 19% and in ash content by 75%, with these excess solids concentrated in a small volume (ca. 6% based on centrifuge feed) of underflow.

EXAMPLE 2

A crude, heavy, high temperature coal tar is dried, heated to 320° F., and passed through the same centrifuge as in Example 1, at a feed rate of 5 GPM and under 2800 G-forces. Results are given below.

| Fraction | % QI | % Ash |
|---|---|---|
| Centrifuge Feed | 20.3 | 0.51 |
| Centrate | 16.7 | 0.13 |
| Underflow | 39.8 | 2.9 |

EXAMPLE 3

A crude, heavy tar (75 parts) is diluted with a light creosote fraction of coal tar (25 parts), the mixture dried, heated to 295° F., and passed through the same centrifuge as in Example 1, at a feed rate of 5 GPM and under 2800 G-forces. Results are given below.

| Fraction | % QI | % Ash |
|---|---|---|
| Centrifuge Feed | 11.0 | 0.75 |
| Centrate | 5.5 | 0.30 |
| Underflow | 42.5 | 3.7 |

The feed is reduced in total solids content by 50% and in ash content by 60%. It should be noted that the light creosote used is free of all solids and does not, therefore, itself contribute to solids concentration. The diluent served to enhance the centrifuging operation, increasing total solids removal from less than 20% (cf. Examples 1 and 2) to about 50%.

EXAMPLE 4

A blend of crude, heavy and light tars is dried, heated to 320° F., and passed through a solid-bowl centrifuge (nominal capacity=50 GPM) at a feed rate of 25 GPM and under 2740 G-forces. Results are given below.

| Fraction | % QI | % Ash |
|---|---|---|
| Centrifuge Feed | 16.2 | 0.55 |
| Centrate | 12.0 | 0.18 |
| Underflow | 42.6 | 2.6 |

The feed is reduced in total solids content by 26% and in ash content by 67%.

EXAMPLE 5

A mixture is prepared of a centrifuge underflow and light creosote (diluent) and is heated to 180° F. with agitation for one hour. The mixture is then pressure-filtered at 50 psig through a 70-by-80 mesh twilled weave stainless-steel screen having a filter area of 0.016 square feet. An initial filter rate is determined and the filtrate returned to the filter to ascertain a recycle filtration rate, which is determined to be 6.0 gallons per hour per square foot of filter area (gph/ft$^2$). Material-balance data and analytical results are given below.

| Fraction | Parts by Weight | % QI | % Ash |
|---|---|---|---|
| Centrifuge Underflow | 45 | 43.9 | 3.2 |
| Light Creosote | 55 | 0.0 | 0.0 |
| Feed to Filter | 100 | 19.8 | 1.4 |
| Filtrate | 72 | 0.2 | 0.01 |
| Filter Cake | 28 | 66.8 | 4.6 |

Thus, more than 94% of the solids in the underflow are concentrated into the filter cake; the filtrate produced has negligible concentrations of total solids and ash.

EXAMPLE 6

A mixture is prepared of a centrifuge underflow and a coal-tar absorption oil (diluent) and is heated to 285° F. with agitation. The mixture is then pressure-filtered at 75 psig through a candle filter having a surface area of 2.15 square feet. Processing rate is determined to be 5.9 gph/ft$^2$ of filter surface area. Material-balance data and analytical results are given below.

| Fraction | Parts by Weight | % QI | % Ash |
|---|---|---|---|
| Centrifuge Underflow | 85.0 | 41.0 | 3.0 |
| Absorption Oil | 15.0 | 0.0 | 0.0 |
| Feed to Filter | 100.0 | 35.3 | 2.4 |

-continued

| Fraction | Parts by Weight | % QI | % Ash |
|---|---|---|---|
| Filtrate | 33.6 | 0.0 | 0.03 |
| Filter Cake | 66.4 | 51.5 | 3.6 |

Approximately 97% of the solids in the underflow reported with the filter cake, and the filtrate produced contained virtually no solids.

EXAMPLE 7

A mixture is prepared of a centrifuge underflow with a diluent comprising filtrate from a previous filtering operation. The mixture is heated to 320° F. with agitation and is then pressure-filtered at 75 psig through the candle filter of Example 6. Processing rate is determined to be 2.9 gph/ft$^2$ of filter surface area. Material-balance data and analytical results are given below.

| Fraction | Parts by Weight | % QI | % Ash |
|---|---|---|---|
| Centrifuge Underflow | 75.0 | 42.6 | 2.6 |
| Filtrate Diluent | 25.0 | 0.2 | 0.02 |
| Feed to Filter | 100.0 | 32.2 | 1.9 |
| Filtrate | 40.3 | 0.2 | 0.02 |
| Filter Cake | 59.7 | 51.8 | 3.2 |

Approximately 96% of the solids in the filter feed were concentrated in the filter cake, and the filtrate contained virtually no solids.

Use of filter aid in the filtering operation of this Example increases the rate of filtration.

We claim:

1. A process for removing solids from coal tar for the preparation of a coal tar pitch containing liquid comprising (1) centrifuging said coal tar at a suitable viscosity to separate large particle size solids and liquid fraction from a first liquid fraction containing pitch and small particle size solids, and (2) filtering said large particle size solids and liquid fraction while maintaining said fraction at a suitable viscosity to thereby produce a second pitch containing liquid fraction which is substantially free of solids, and a densified readily handleable large particle size solid material.

2. Process as in claim 1 wherein the average particle size of said small particle size solids is less than about 10 microns.

3. Process as in claim 1 wherein the viscosity of said coal tar during centrifuging is maintained by controlling the temperature of said coal tar and/or the amount and type of diluent mixed with said coal tar.

4. Process as in claim 1 wherein said second liquid fraction has a solids content of less than about 2% by weight.

5. Process as in claim 4 wherein the viscosity of said tar during centrifuging is maintained below about 400 SUS.

6. Process as in claim 5 wherein said viscosity of said coal tar during centrifuging is controlled by varying temperature of said coal tar between about 140° F. and about 325° F.

7. Process as in claim 3 wherein said diluent is a coal tar liquid.

8. Process as in claim 1 wherein said centrifuging is carried out using a solid-bowl type centrifuge.

9. Process as in claim 1 wherein the viscosity of said large particle size solids and liquid fraction is maintained by mixing said fraction with a suitable diluent.

10. Process as in claim 1 comprising the additional step of distilling one or more of the liquid fractions separated in the separation steps of this invention to thereby produce a pitch product which is useful (1) as a binder for carbon anodes for aluminum reduction cells, (2) as a binder for graphite electrodes for electric arc steelmaking furnaces, (3) as an impregnating pitch for the manufacture of graphite electrodes, or (4) for the production of needle coke or carbon fibers.

11. Process as in claim 8 wherein said filter is a screen-type filter.

12. Process as in claim 1 wherein said large particle size solids and liquid fraction is filtered at the rate of at least about one gallon per hour per square foot of filter surface area.

13. Process as in claim 1 wherein said rate is at least six gallons per hour per square foot without the use of a filter aid.

14. Process as in claim 1 wherein a filter aid is used in the filtering step.

15. A process for removing solids from a high temperature coal tar for the preparation of coal tar pitch containing liquid comprising (1) centrifuging said coal tar having a suitable viscosity to thereby separate a large particle size solids and liquid fraction from a first liquid fraction containing pitch and small particle size solids, and (2) filtering said large particle size solids and liquid fraction, while maintaining said fraction at a suitable viscosity, to thereby produce a second pitch containing liquid fraction which is substantially free of solids, and a densified readily handleable large particle size solid material.

16. Process as in claim 15 wherein the average particle size of said small particle size solids is less than about 10 microns.

17. Process as in claim 15 wherein the viscosity of said coal tar during the centrifuging step is maintained by controlling the temperature of said coal tar and/or the amount and type of diluent mixed with said coal tar.

18. Process as in claim 15 wherein the viscosity of said coal tar during centrifuging is maintained between about 100 and about 200 SUS.

19. Process as in claim 18 wherein said viscosity of said coal tar during centrifuging is controlled by varying temperature of said coal tar between about 200° F. and about 300° F.

20. Process as in claim 15 comprising the additional step of distilling said first liquid fraction to thereby produce a pitch product which is useful as a binder for (1) carbon anodes for aluminum reduction cells, and/or (2) for graphite electrodes for electric arc steelmaking furnaces.

21. Process as in claim 15 comprising the additional step of distilling said second liquid fraction to thereby produce a pitch product which is useful (1) as an impregnating pitch for the manufacture of graphite electrodes, and/or (2) for the production of needle coke or carbon fibers.

22. Process as in claim 15 wherein said filter is a screen-type filter.

23. A process for removing solid contaminants from a high temperature coal tar comprising (1) drying said coal tar to produce an essentially dry coal tar, (2) mixing into said coal tar a suitable diluent to adjust the viscosity of said coal tar to a suitable viscosity for carrying out the objects of step (3), (3) centrifuging said coal tar having a suitable viscosity to separate a large particle size solids and liquid fraction from a first liquid fraction containing pitch and small particle size QI solids, (4) mixing said large particle size solids and liquid fraction with a suitable diluent to thereby maintain a readily filterable viscosity in said separated large particle size solids and liquid fraction, and (5) filtering said large particle size solids and liquid fraction while maintaining said fraction at said readily filterable viscosity to thereby produce a second pitch containing liquid fraction which is substantially free of solids, and a densified readily handleable substantially dry filter cake.

24. Process as in claim 23 wherein said second liquid fraction contains less than about two percent by weight of QI solids.

25. Process as in claim 24 wherein said second liquid fraction contains less than one percent by weight of QI solids.

26. Process as in claim 23 wherein the average particle size of said small particle size solids is less than about 10 microns and the average particle size of said large particle size solids is greater than about 10 microns.

27. Process as in claim 23 wherein the diluents used in this process comprise said first or second liquid fractions produced by this process, coal tar, or coal tar distillate materials.

28. Process as in claim 27 wherein the diluents are at least one member selected from the group consisting of primary-cooler tar from coke oven gas cleaning, creosote fractions from the distillation of coal tar, and the full-range distillate from distillation of coal tar.

* * * * *